United States Patent [19]

Ohman et al.

[11] Patent Number: 4,473,102

[45] Date of Patent: Sep. 25, 1984

[54] DRAPERY CARRIER FOR A STRING CONNECTED CARRIER SYSTEM

[75] Inventors: Thor Ohman, Madison; Lester R. Small, De Forest, both of Wis.

[73] Assignee: Graber Industries, Inc., Middleton, Wis.

[21] Appl. No.: 439,915

[22] Filed: Nov. 8, 1982

[51] Int. Cl.[3] ..... A47H 5/00

[52] U.S. Cl. ..... 160/345; 16/87.4 R; 24/136 K

[58] Field of Search ..... 160/345, 344, 346, 347, 160/126, 12.4, 123, 166 A; 16/93 D, 94 D, 87.4; 24/115 M, 136 K

[56] References Cited

U.S. PATENT DOCUMENTS

| | | | |
|---|---|---|---|
| 345,153 | 7/1886 | Latchford | 24/136 K |
| 3,095,033 | 6/1963 | Polkosnik | 160/126 X |
| 3,434,524 | 3/1969 | Fein | 160/345 |
| 3,522,621 | 8/1970 | Ford et al. | 16/87.4 R |
| 3,951,196 | 4/1976 | Salzmann | 160/345 |
| 3,951,197 | 4/1976 | Cohen | 160/346 |
| 4,034,439 | 7/1977 | Köhne | 160/345 |

FOREIGN PATENT DOCUMENTS

| | | | |
|---|---|---|---|
| 223130 | 10/1924 | United Kingdom | 160/344 |

*Primary Examiner*—Peter M. Caun
*Assistant Examiner*—Cherney S. Lieberman
*Attorney, Agent, or Firm*—Vernon J. Pillote

[57] ABSTRACT

A carrier for supporting a panel for movement along a track and adapted for connection to a string for controlling the spacing of the carriers along the track. The carrier includes a carrier body having a key receiving cavity, a locking key integrally connected to the body by a frangible connection arranged to allow an intermediate portion of a string to be inserted laterally into a position extending crosswise of the cavity. The key is then forced into the cavity to form a loop in the string and lock the string to the carrier body.

14 Claims, 17 Drawing Figures

Fig. 1.
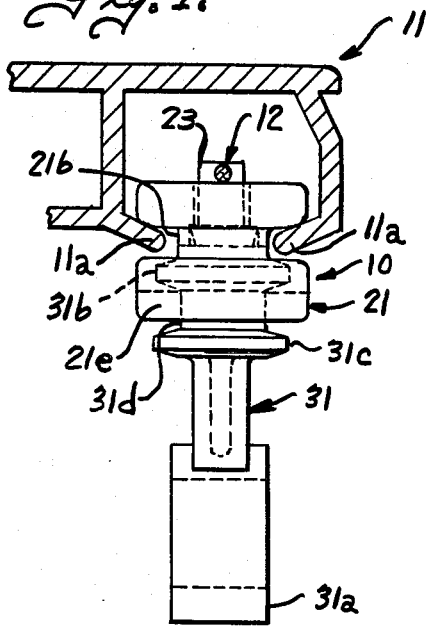
Fig. 2.
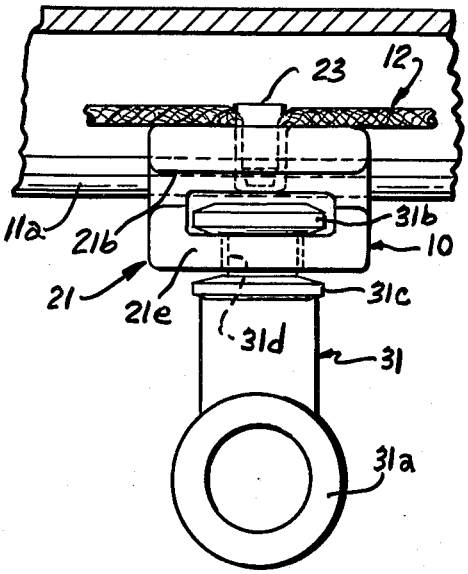
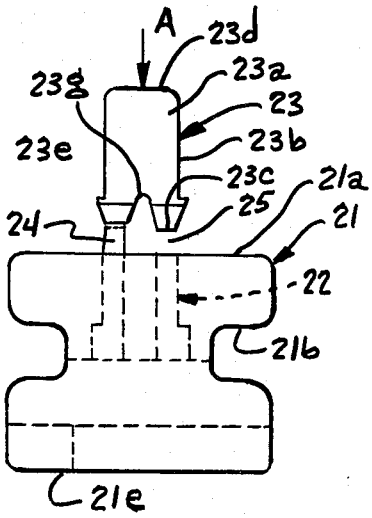
Fig. 3.
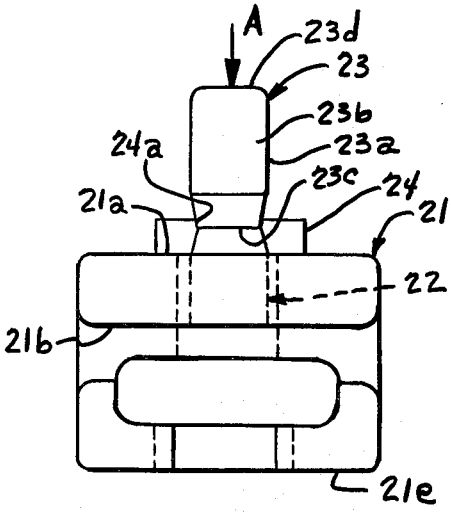
Fig. 4.

Fig. 5.
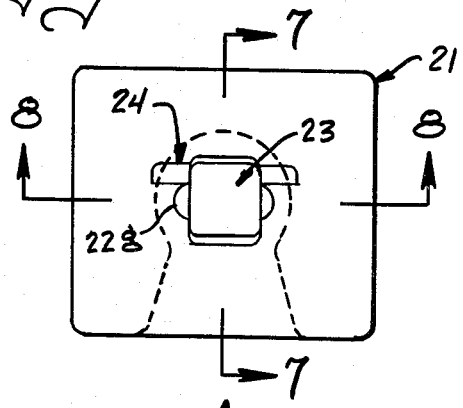
Fig. 6.
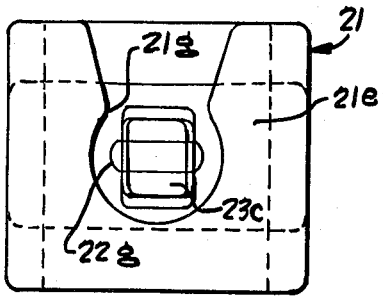
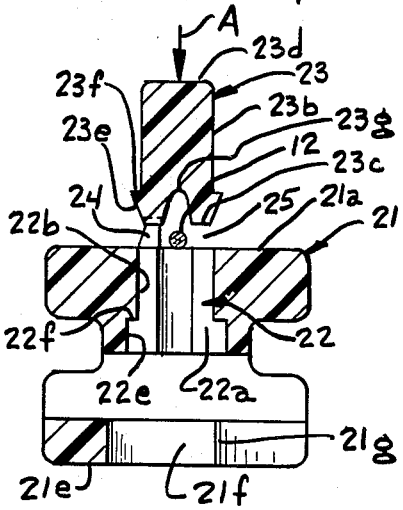
Fig. 7.
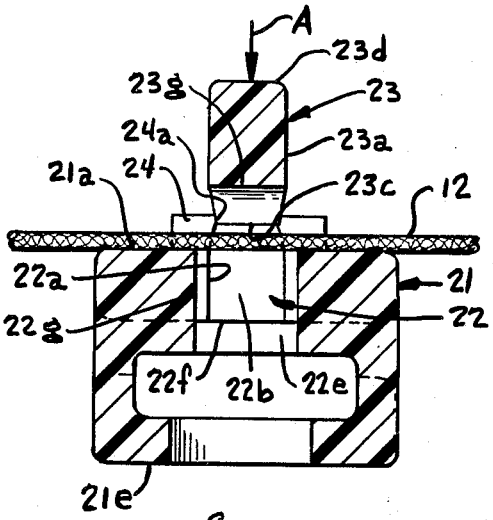
Fig. 8.
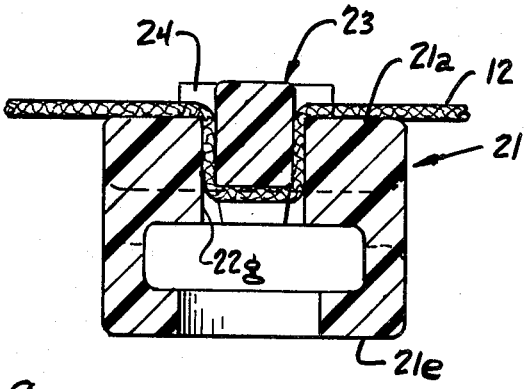
Fig. 9.

Fig. 14.
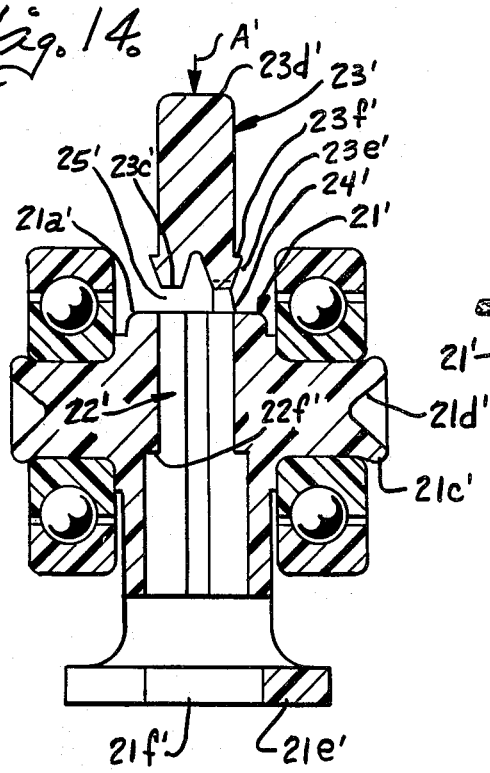
Fig. 15.
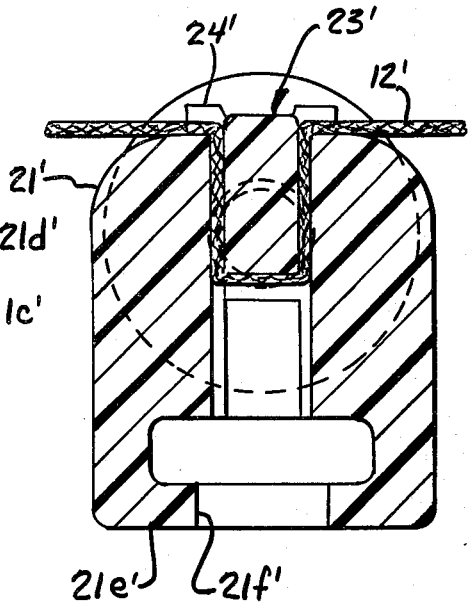
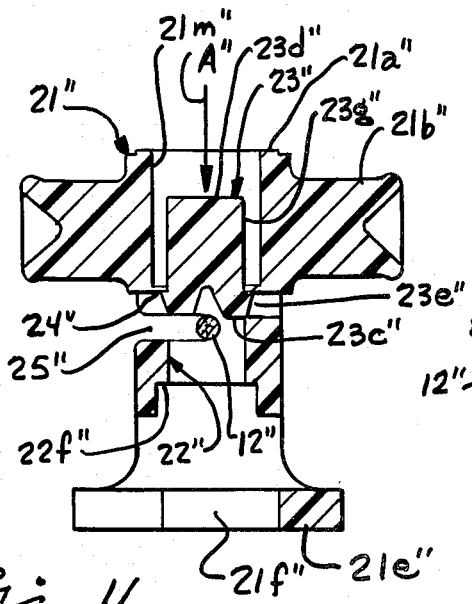
Fig. 16.
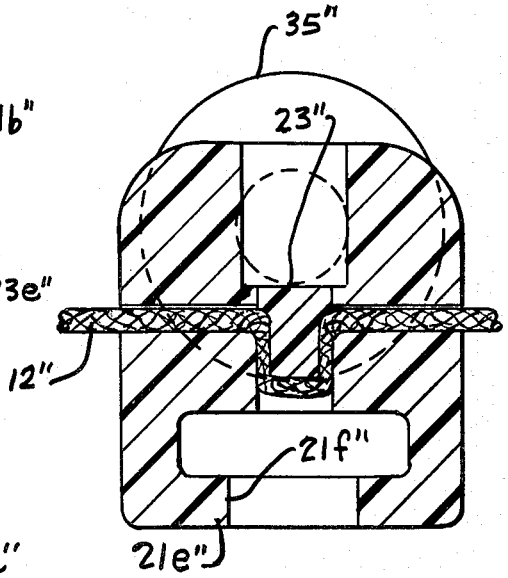
Fig. 17.

DRAPERY CARRIER FOR A STRING CONNECTED CARRIER SYSTEM

BACKGROUND OF THE INVENTION

Interconnected drapery carrier systems of the type having a plurality of drapery carriers attached at spaced locations along a string are known. The drapery carriers have panel mounting means adapted for attachment to a drapery panel at spaced locations along the drapery panel heading, and the lead or spacing of the carriers along the string is selected so that the flexible string controls the spacing between the carriers when the drapery panel is closed to produce generally uniform pleats or folds in the drapery panel. When such drapery carrier systems are used on traverse rods, one end of the string is connected to a master carrier so that the master carrier draws a string of interconnected carriers along the rod when it is moved to a position to close the drapes.

In the string connected carrier system such as disclosed in U.S. Pat. Nos. 3,434,524 and 3,951,196, the carriers are connected to the string at spaced locations therealong by being molded directly on the string. In the string connected carrier system disclosed in U.S. Pat. No. 3,522,621, buttons are molded on the string at spaced locations along the string and the buttons thereafter detachably connected to the carriers to control the spacing between the carriers. However, molding of parts such as drapery carriers or buttons at spaced locations along a string requires a more complex molding apparatus and the molding operation is also somewhat slower than molding similar parts without the string. In addition, the resistance to slippage of the molded part on string is dependent on the material used for the molded part and on the material and type of string. For example, if the string is a mono-filament type or if the string is of the multi-strand type having a very tight twist or braid, parts molded on the string sometime slip along the string and produce an undesirable variation in the spacing between adjacent carriers.

U.S. Pat. No. 3,951,196 discloses a string connected carrier system in which the string extends through a slot in the carriers and knots or beads are provided at spaced locations along the string to engage the carrier at opposite ends of the slot. However, this arrangement requires that the string be specially formed with the knots or beads at spaced locations therealong and increases the overall cost of the string connected carrier system.

SUMMARY OF THE INVENTION

It is an object of this invention to overcome the disadvantages of the prior string connected carrier systems by providing a carrier which can be assembled on and locked to the string in any desired location along the string.

Another object of this invention is to provide a carrier which can be economically formed, assembled on the string and locked to a string, to provide an economical string connected carrier system.

Accordingly, the present invention provides a carrier means for supporting a panel for movement along a track and adapted for connection to a string to control spacing of the carrier means along the track, the carrier means including a carrier body having a key receiving cavity therein and a locking key adapted to be moved along a path into the cavity and integrally connected to the carrier body by a yieldable connecting means with the locking key aligned along the path with the cavity, the carrier body and locking key and yieldable connecting means being constructed and arranged to provide a laterally opening string receiving passage extending crosswise of the path to allow an intermediate portion of the string to be moved laterally into a position extending crosswise of the cavity, the yieldable connecting means being adapted to yield when a force is applied to the locking key in a direction to move the locking key along the path into the cavity whereby the locking key draws a loop of the string into the cavity and locks the loop of string to the carrier body.

These, together with other objects, features and advantages of this invention will become apparent from the following description and the accompanying drawings wherein:

FIG. 1 is a fragmentary transverse sectional view through a drapery rod embodying a string connected carrier system constructed in accordance with the present invention;

FIG. 2 is a fragmentary longitudinal sectional view through the drapery rod of FIG. 1 and illustrating one of the string connected carriers in side elevation;

FIG. 3 is an end elevational view of a carrier prior to assembly and locking on a string;

FIG. 4 is a side elevational view of the carrier of FIG. 3;

FIG. 5 is a top plan view of the carrier of FIG. 3;

FIG. 6 is a bottom plan view of the carrier of FIG. 3;

FIG. 7 is a transverse sectional view through the carrier taken on the plane 7—7 of FIG. 5 and illustrating assembly of a carrier on the string;

FIG. 8 is a longitudinal sectional view through the carrier taken on the plane 8—8 of FIG. 5 and illustrating assembly of the carrier on a string;

FIG. 9 is a longitudinal sectional view through the carrier illustrating the carrier locked on the string;

FIG. 14 is a transverse sectional view taken on the plane 14—14 of FIG. 13;

FIG. 15 is a longitudinal sectional view through the carrier taken on the plane 15—15 of FIG. 10;

FIG. 16 is a transverse sectional view through a further modified form of string connected carrier, illustrating the carrier assembled on a string, but not locked thereto; and FIG. 17 is a longitudinal sectional view through the carrier of FIG. 16 illustrating the carrier locked on the string.

Figure 10:
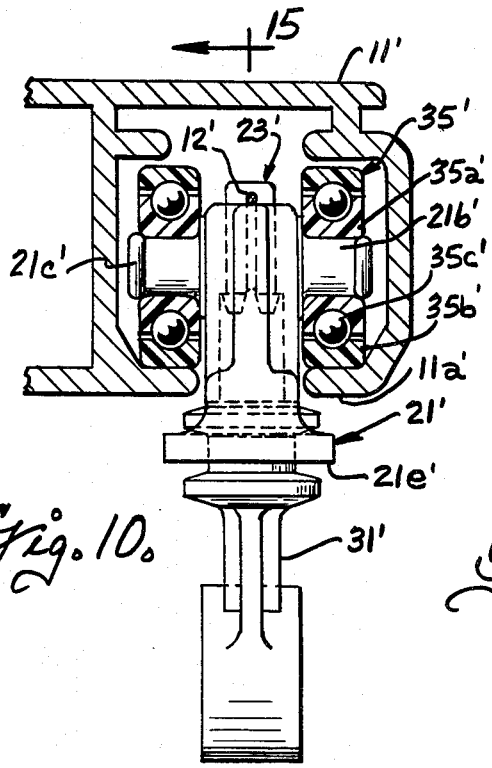
FIG. 10 is a fragmentary transverse sectional view through a rod illustrating another embodiment of the string connected carrier system.

The carrier means 10 of the present invention are generally adapted for supporting a panel for movement along a track 11 and are adapted for connection to a string 12 which controls the spacing of the carrier means along the track. The interconnected carrier means are advantageously utilized to support a flexible panel such as a drapery on a drapery rod to draw the draperies to their closed position and to control spacing between the carriers when the drapery is closed to produce generally uniform pleats or folds in the drapery. It is apparent, however, that the interconnected carrier means can also be utilized to support rigid panels such as hingedly interconnected panels utilized in some folding doors, or louvers utilized in venetian type blinds. As used herein, the term "panel" is intended to cover both flexible panels such as draperies as well as rigid panels as described above. The string utilized to interconnect the carriers can be any elongated flexible element and may be a single strand string or a multiple strand string in which several strands are twisted or braided together. The track can be of various different constructions adapted to support the carriers for movement therealong and may comprise a drapery rod, a header or the like.

Reference is now made more specifically to the embodiment of the carrier means disclosed in FIGS. 1–9. The carrier means includes a carrier body 21 having a key receiving cavity 22 therein and a locking key 23 adapted to be moved along a path A into the cavity. The locking key is integrally connected to the carrier body by a yieldable connecting means 24 which supports the locking key in a position aligned along the path with the cavity. The carrier body, locking key and yieldable connecting means are formed by the molding in one-piece of a synthetic resin material and may, for example, be formed of an acetal resin. The carrier body, locking key and yieldable connecting means are constructed and arranged to provide a lateral opening string receiving passage 25 extending crosswise of the path of movement of the key to allow an intermediate portion of string 12 to be moved laterally into a position extending crosswise of the cavity, as shown in FIGS. 7 and 8. The yieldable connecting means 24 is adapted to yield when a force is applied to the locking key in a direction to move the locking key along the path A into the cavity and the locking key draws a loop of the string into the cavity and locks the loop of the string to the carrier body, as best shown in FIGS. 2 and 9. The locking key is preferably in the form of a plug having a non-circular cross-section, and the cavity 22 has a complementary non-circular cross-section to non-rotatably receive the plug when it is moved along the path A coinciding with the plug-cavity axis.

As shown, the plug has a generally rectangular cross-section with a first pair of opposed side faces **23*a* and a second pair of opposed side faces 23*b* extending between the side faces at 23*a*, a lead end face 23*c* and a trail end face 23*d* at the end opposite the lead end face. The cavity 22 also has a generally rectangular cross-section with a first pair of opposed side faces 22*a* spaced apart a distance to receive the side faces 23*a* of the plug therebetween, and a second pair of opposed side faces 22*b* spaced apart to receive the side faces 23*b* of the plug therebetween. Interengaging plug locking means are provided on the plug and carrier body for locking the plug in the cavity after it is inserted thereinto. The interengaging plug locking means includes integral wedge shape protrusions 23*e* on at least one pair of the opposed side walls 23*b* adjacent the lead end of the plug, and which protrusions diverge outwardly relative to each other and define a transverse locking shoulder 23*f* at the rear side of the protrusions. The inner end of the cavity 22 has wall portions 22*e* offset relatively farther apart than the side faces 22*b* and which define an inwardly facing transverse shoulder 22*f* at the inner ends of the side faces 22*b*. The plug has a V-shaped groove 23*g* extending into its lead end and disposed in a plane intermediate the wedge shape protrusions 23*e*, and the wedge shape protrusions are adapted to be cammed inwardly as the plug is pressed into the cavity. The protrusions 23*e* then move outwardly to engage the shoulders 23*f* on the plug with the shoulders 22*f*** in the cavity to lock the plug in the cavity.

The carrier 21 has an upper end face **21*a* and the yieldable connecting means 24 comprises one or more, and herein shown as two, relatively thin web sections formed integrally with the carrier body 21 and plug 23 and which extend from the upper surface 21*a* at a location offset to one side of the center of the plug and cavity axis and which space the lead end 23*c* of the plug above the upper surface 21*a* of the carrier body to provide the aforementioned laterally opening string receiving passage 25. As best shown in FIGS. 4 and 8, the webs that form the yieldable connecting means 24 are integrally joined to the plug adjacent its lead end in a relatively small area designated 24*a*, and the size of the area is selected in accordance with the material from which the carrier body and plug are formed so as to be frangible or readily breakable when a force is applied to the plug along its axis in a direction to force the plug along the path A into the cavity. With this arrangement, the string 12, at any desired intermediate portion therealong, can be inserted laterally through the laterally opening passage 25 into a position between the lead end of the plug and the end face 21*a* on the carrier body, as shown in FIGS. 7 and 8, and the plug thereafter forced, either by a hand impact tool or by a press or the like, along its axis into the cavity. The yieldable connecting means 24 ruptures or breaks as the plug is moved downwardly and the plug draws a loop of the string into the cavity and locks the loop of the string to the carrier body. The V-shaped notch 23*g* in the lead end of the plug is arranged to receive the string and to laterally position and retain the string during movement of the plug into the cavity. In addition, the side walls 22*a* of the cavity are preferably provided with string receiving recesses 22*g* adapted to receive the loop of the string as it is drawn into the cavity. Preferably, the recesses 23*g* have a depth sufficiently less than the cross-section of the string such that the string is firmly clamped between the walls of the plug and the walls of the cavity. As best shown in FIG. 9, when the plug is inserted into the cavity, the string is drawn into a loop having four relatively sharp bends, and this provides a firm locking of the string to the carrier body. In addition, the V-shaped groove 23*g*** in the lead end of the plug is preferably shaped to provide a wedge grip on the string.

In the embodiment of FIGS. 1–9, the carrier body is adapted to be slidably supported on spaced flanges **11*a* of the trackway 11. For this purpose, the carrier body has grooves 21*b* along opposite sides and extending in a plane transverse to the axis of the plug and cavity, adapted to slidably receive the flanges 11*a* to support the carrier for movement along the track. A panel support means 31 is provided on each carrier and, in the embodiment shown in FIGS. 1 and 2, the panel support means is mounted for swivel movement about an axis generally aligned with the plug axis. The carrier body 21 is provided with a lower support wall 21*e* that is spaced below the flange receiving grooves 21*b*, and which has a keyhole shaped opening 21*f* opening at one side of the carrier body. The panel supports 31 have a panel mounting means 31*a* at their lower ends and upper and lower head portions 31*b* and 31*c* at their upper ends that are spaced apart by a generally cylindrical connecting portion 31***d*. The connecting portion 31*d* is dimensioned to be rotatably receivable in the circular portion of the keyhole shaped opening 21*f*, and the circular portion of the keyhole shaped opening extends through an arc of somewhat greater than 180° to provide a restricted portion 21*g* dimensioned to allow the portion 31*d* of the panel support to snap into the opening 21*f* and releasably retain it in the opening. The upper and lower head portions 31*b* and 31*c* are arranged respectively to engage the upper and lower sides of the wall 21*e* to limit vertical movement of the panel support.

A modified form of interconnected carrier system is illustrated in FIGS. 10–15. The carrier system shown in FIGS. 10–15 is generally similar to that shown in FIGS. 1–9 and like numerals followed by the postscript' are used to designate corresponding parts. The carrier body 21' has a plug receiving cavity 22' formed therein and a plug 23' adapted to be inserted along an axis A' into the cavity and integrally connected to the carrier body by a frangible connecting means 24'. The plug has a lead end 23*c'* and a trail end 23*d'* and the frangible connecting means is formed integrally with the top wall 21*a'* of the carrier body, at one side of the cavity axis and supports the plug with its lead end 23*c'* spaced above the top wall of the carrier body to provide a laterally opening string receiving passage 25' extending crosswise of the plug-cavity axis between the top wall of the carrier body and the lead end of the plug to allow an intermediate portion of a string 12' to be moved laterally from one side of the axis into a position extending crosswise of the end of the cavity. As in the preceding embodiment, the plug has latch means 23*e'*, 23*f'* arranged to engage a transverse shoulder 22*f'* at the inner end of the cavity 22', to lock the plug in the cavity when it is moved to a position as shown in FIG. 15.

Figure 11:
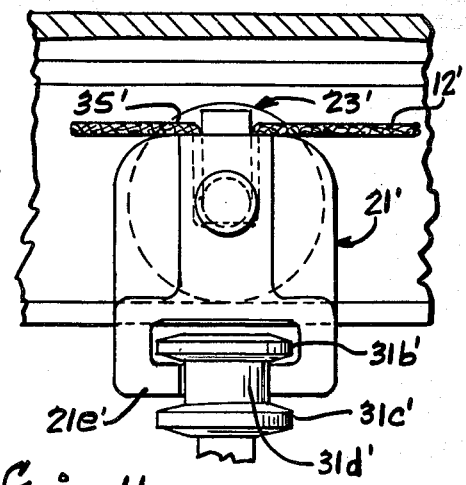
FIG. 11 is a fragmentary longitudinal sectional view through the rod of FIG. 10 and illustrating one of the string connected carriers in side elevation.
Figure 12:
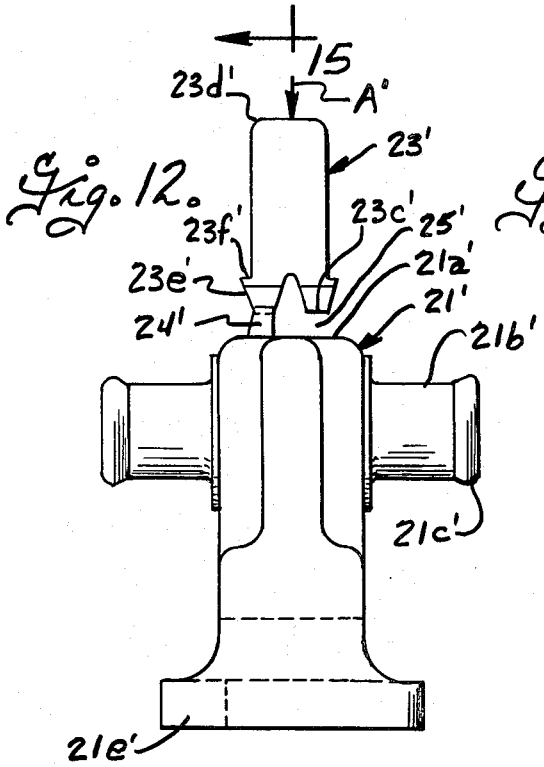
FIG. 12 is an end elevational view of the carrier of FIG. 10 prior to assembly on a string.
Figure 13:
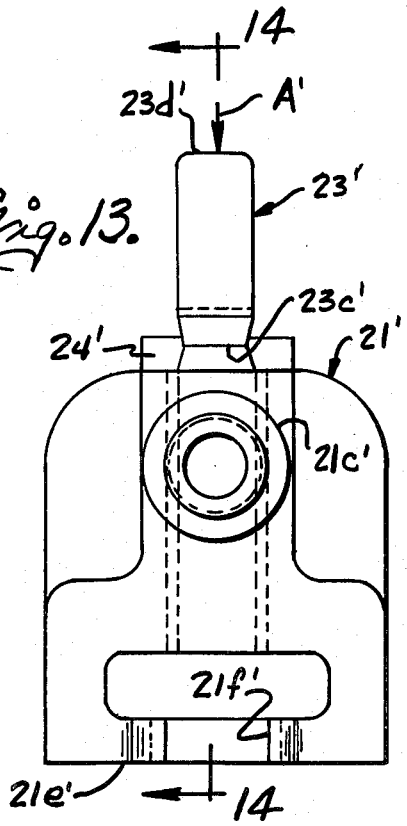
FIG. 13 is a side elevational view of the carrier of FIG. 10 prior to assembly on a string.

The embodiment of FIGS. 10–15 differs from the previous embodiment primarily in the provision of rollers 35' for supporting the carrier means for movement along a trackway 11'. As best shown in FIGS. 10 and 11, the rollers are adapted to engage and be supported on flanges 11*a'* on a track 11' and the rollers 35' are mounted on laterally extending trunnions 21*b'* conveniently formed integrally with the carrier body 21'. In the embodiment shown, the rollers 35' are of the anti-friction type and include an inner race 35*a'* and an outer race 35*b'*, with anti-friction elements such as balls 35*c'* interposed between the inner and outer races. The inner race 35*a'* is retained on the trunnion as by a retaining rim 21*c'*, and the ends of the trunnions are formed with a conical recess 21*d'* as best shown in FIG. 14 to allow the rim portions to deform inwardly when the rollers are pressed on the trunnions. As is apparent, it is not essential that the rollers be of the anti-friction type and the rollers may be solid rollers rotatably supported on the trunnions 21*b'*. A panel support 31' is provided on each carrier and in the embodiment shown is of the same form as that described at 31 in connection with the embodiment of FIGS. 1–9. The carrier body has a wall 21*e'* spaced below the underside of the rollers and a keyhole shaped opening 21*f'* formed in the wall for receiving the neck portion 31*d'* on the upper end of the panel supports. As in the preceding embodiment, the upper and lower head portions 31*b'* and 31*c'* on the panel supports are arranged to engage the upper and lower sides of the wall 21*e'* adjacent the opening 21*f'*, to limit vertical movement of the panel supports relative to the carriers.

A further modified form of carrier means is illustrated in FIGS. 16 and 17 and like numerals followed by the postscript" are used to designate corresponding parts. In this embodiment the carrier body 21" is formed with a plug receiving cavity 22" spaced downwardly from its upper end. A plug 23" adapted to be inserted along an axis A" into the cavity, is integrally connected to the carrier body by frangible connecting means 24". The plug has a non-circular and preferably rectangular cross-section similar to that previously described in connection with the other embodiments and the plug receiving cavity 22" similarly has a generally non-circular cross-section adapted to be non-rotatably received in the plug receiving cavity 22". The plug is supported by the frangible connecting means 24" in an enlarged upper cavity or passage 21*m"* in the upper portion of the carrier body. As best shown in FIG 16, the upper passage 21*m"* has a cross-section substantially larger than the cross-section of the plug, to allow a tool to be inserted into the upper passage to depress the plug, and the frangible connecting means 24" is in the form of a thin web that extends between the plug and the walls of the upper cavity 21*m"*. The frangible connecting means 24" supports the plug with its lead end 23*c"* above the plug receiving cavity 22" and, as shown, the trail end 23*d"* of the plug is spaced below the upper side 21*a"* of the carrier body. The carrier body is formed with a laterally opening notch or recess 25" at a location above the plug receiving cavity 22" and below the lead end 23*c"* of the plug, to allow an intermediate portion of the string 12" to be moved laterally from one side of the axis into a position extending crosswise of the upper end of the plug receiving cavity 22", as shown in FIG. 16. The frangible connecting means 24" is adapted to break when a force is applied to the trail end of the plug in a direction to move the lead end of the plug along the axis A" into the plug receiving cavity 22", so that the plug draws a loop of the string into the cavity 22" and locks the loop of the string to the carrier body, as shown in FIG. 17. As in the preceding embodiments, the plug has a generally wedge shaped locking means 23*e"* on its lead end defining a transverse shoulder arranged to engage and lock against a transverse shoulder 22*f"* at the inner end of the plug receiving cavity 22". The lead end of the plug is conveniently formed with a V-shaped recess or groove 23*g"* adapted to receive and locate the string 12" when the plug is moved into the plug receiving cavity. In the carrier illustrated in FIGS. 16 and 17, the carrier body is adapted to be supported by rollers 35" on a trackway similar to that shown at 11' in the embodiment of FIGS. 10–15, with the rollers supported on trunnions 21*b"* formed integrally with the carrier body. The lower end of the carrier body is provided with a wall 21*e"* having a keyhole shaped opening 21*f"* similar to that described in connection with the preceding embodiments, and adapted to receive a panel support member similar to that shown at 31 and 31' in the preceding embodiments.

From the foregoing it is felt that the construction and use of the carrier means will be readily understood. The carrier body, plug and frangible connection are formed in one piece as by molding from a synthetic resin material and are molded separate from the string. The carrier body is formed with a plug receiving cavity and the plug is adapted to be moved along a path into the plug receiving cavity and is integrally connected with the carrier body by the frangible connecting means with the plug aligned along the path with the cavities. The carrier body, plug and frangible connecting means are constructed and arranged to provide a laterally opening string receiving passage between the lead end of the plug and the end of the plug receiving cavity so that an intermediate portion of a string can be moved laterally into a position extending crosswise of the plug receiving cavity. The plug can be then forced into the plug receiving cavity, as by a hand impact tool or by a press, and the plug draws a loop of the string into the cavity and locks the string to the carrier body. Since the plug is integrally connected to the carrier body, it is not necessary to provide a separate means for feeding or positioning the plug in relation to the carrier body during insertion of the plug into the plug receiving cavity. Further, the carriers can be positioned at any desired location intermediate the ends of the string. This facilitates formation of string connected carriers with different carrier spacing or pitch along the string and also facilitates formation of a string carrier system in which the spacing between adjacent carriers varies along the length of the string, for example as described in U.S. Pat. No. 3,951,196.

The embodiments of the invention in which an exclusive property or privilege is claimed as defined as follows:

1. Carrier means for supporting a panel for movement along a track and adapted for connection to a string for controlling spacing of the carrier means along the track, the carrier means including a carrier body having a key receiving cavity therein and a locking key adapted to be moved along a path into the cavity and integrally connected to the carrier body by a yieldable connecting means with the locking key aligned along said path with the cavity, the carrier body and locking key and yieldable connecting means being constructed and arranged to provide a laterally opening string receiving passage extending crosswise of said path to allow an intermediate portion of a string to be moved laterally into a position extending crosswise of the cavity, the yieldable connecting means being adapted to yield when a force is applied to the locking key in a direction to move the locking key along said path into the cavity whereby the locking key draws a loop of the string therewith into the cavity and locks the loop of string to the carrier body.

2. Carrier means according to claim 1 wherein the carrier body has groove means at opposite sides disposed in a plane transverse to said path for slidably supporting the carrier means on a rod.

3. Carrier means according to claim 1 wherein the carrier body has rollers mounted at opposite sides thereof for rotation about a roller axis transverse to said path to support the carrier means for movement along a rod.

4. Carrier means according to claims 1, 2 or 3 wherein the carrier body, locking key and yieldable connecting means are molded in one-piece of a synthetic resin material.

5. Carrier means according to claim 1 including interengaging means on said key and carrier body for locking said key against withdrawal from the cavity.

6. Carrier means according to claim 1 wherein the key has a string receiving groove means for receiving and locating the string when the key is moved into the cavity.

7. Carrier means for supporting a panel for movement along a track and adapted for connection to a string for controlling spacing of the carrier means along the track, the carrier means including a carrier body having a plug receiving cavity therein and a wall portion extending transverse to one end of the plug receiving cavity, a plug having a lead end and adapted to be inserted along an axis with its lead end forward into the cavity and integrally connected to the carrier body by frangible connecting means with the plug aligned along said axis with the cavity, the frangible connection supporting the plug with its lead end spaced from said wall portion at said one end of the cavity, said carrier body and plug and connecting means constructed and arranged to provide a laterally opening string receiving passage extending crosswise of said axis between said wall means and the lead end of the plug to allow an intermediate portion of a string to be moved laterally from one side of said axis into a position extending crosswise of said one end of the cavity, the frangible connecting means being adapted to break when a force is applied to the plug in a direction to move the lead end of the plug along said axis into the cavity whereby the plug draws a loop of the string therewith into the cavity and locks the loop of string to the carrier body.

8. Carrier means according to claim 7 wherein said carrier body, plug and frangible connecting means, are molded in one-piece of a synthetic resin material.

9. Carrier means according to claim 7 wherein the lead end of said plug has groove means therein for receiving and locating the string when the plug is moved into the cavity.

10. Carrier means according to claim 7 wherein said carrier body has groove means along opposite sides of the cavity adapted to receive the string when the plug is moved into the cavity, the groove means having a depth sufficiently less than the cross-section of the string to press portions of the string firmly against the opposite sides of the plug when the latter is pressed into the cavity.

11. Carrier means according to claim 7 including interengaging means on said plug and carrier body for locking the plug against withdrawal from the cavity.

12. Carrier means according to claim 7 wherein the carrier body has groove means at opposite sides disposed in a plane transverse to said axis for slidably supporting the carrier means on a rod.

13. Carrier means according to claim 7 wherein the carrier body has rollers mounted at opposite sides thereof for rotation about a roller axis transverse to said first mentioned axis to support the carrier means for movement along a rod.

14. Carrier means according to claim 7 wherein the carrier means includes drapery support means swivelly attached to said carrier body for turning movement about a swivel axis substantially aligned with said first mentioned axis.

* * * * *

UNITED STATES PATENT AND TRADEMARK OFFICE

CERTIFICATE OF CORRECTION

PATENT NO. : 4,473,102

DATED : September 25, 1984

INVENTOR(S) : Thor Ohman

It is certified that error appears in the above-identified patent and that said Letters Patent are hereby corrected as shown below:

In Claim 7, column 8, line 18, after "means" insert -- being --.

Signed and Sealed this

*Twenty-sixth* Day of *February 1985*

[SEAL]

*Attest:*

DONALD J. QUIGG

*Attesting Officer*

*Acting Commissioner of Patents and Trademarks*